US010875326B2

(12) United States Patent
Moore et al.

(10) Patent No.: US 10,875,326 B2
(45) Date of Patent: Dec. 29, 2020

(54) PRINTING DEVICE AND METHOD OF USING THE SAME

(71) Applicant: Xerox Corporation, Norwalk, CT (US)

(72) Inventors: Steven R. Moore, Pittsford, NY (US); Xin Yang, Webster, NY (US); Alexander J. Fioravanti, Penfield, NY (US); Paul J. McConville, Webster, NY (US); Vincent M. Williams, Palmyra, NY (US); David P. Lomenzo, Pittsford, NY (US); Michael F. Leo, Penfield, NY (US); Jason O'Neil, Rochester, NY (US); Wayne A. Buchar, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/728,003

(22) Filed: Oct. 9, 2017

(65) Prior Publication Data

US 2018/0029381 A1 Feb. 1, 2018

Related U.S. Application Data

(63) Continuation of application No. 15/166,874, filed on May 27, 2016, now Pat. No. 9,827,790.

(51) Int. Cl.

| | |
|---|---|
| ***B41J 11/00*** | (2006.01) |
| ***B41J 15/16*** | (2006.01) |
| ***B41M 7/00*** | (2006.01) |
| ***B41M 3/00*** | (2006.01) |
| ***B41J 3/407*** | (2006.01) |

(52) U.S. Cl.
CPC ..... *B41J 11/002* (2013.01); *B41J 3/407* (2013.01); *B41J 15/16* (2013.01); *B41M 3/008* (2013.01); *B41M 7/0081* (2013.01)

(58) Field of Classification Search
CPC ..... B41M 5/0064; B41M 5/0011; B41J 3/407
USPC ..... 347/16
See application file for complete search history.

(56) References Cited

U.S. PATENT DOCUMENTS

| | | | | |
|---|---|---|---|---|
| 7,244,021 | B2 * | 7/2007 | Arai | B41J 3/543 347/101 |
| 9,321,289 | B2 * | 4/2016 | Yoshii | B41J 3/4075 |
| 2004/0135828 | A1 * | 7/2004 | Schmitt | B41J 3/407 347/2 |
| 2005/0078133 | A1 * | 4/2005 | Molinet | B41J 2/2139 347/12 |

(Continued)

*Primary Examiner* — Lam S Nguyen
(74) *Attorney, Agent, or Firm* — Simpson & Simpson, PLLC

(57) ABSTRACT

A system for printing at least one stretchable ink on a thermoformable substrate including an unwinder arranged to feed the thermoformable substrate from a first roll into a web drive subsystem, a surface energy modification device arranged to alter a substrate surface energy to enhance wetting and adhesion of the at least one stretchable ink to the thermoformable substrate, at least one printhead array arranged to deposit the at least one stretchable ink on the thermoformable substrate, at least one radiation curing device arranged to cure the at least one stretchable ink on the thermoformable substrate, a sensor array arranged to monitor the at least one stretchable ink on the thermoformable substrate, and a rewinder arranged to receive the thermoformable substrate and to form the thermoformable substrate into a second roll.

16 Claims, 5 Drawing Sheets

(56) References Cited

U.S. PATENT DOCUMENTS

| | | | | |
|---|---|---|---|---|
| 2006/0082604 | A1* | 4/2006 | Florence | B41J 3/407<br>347/5 |
| 2011/0243581 | A1* | 10/2011 | Viturro | B41J 2/515<br>399/15 |
| 2014/0160197 | A1* | 6/2014 | Hirose | B41M 5/0011<br>347/16 |

* cited by examiner

PRINTING DEVICE AND METHOD OF USING THE SAME

CROSS-REFERENCE TO RELATED APPLICATIONS

This application is a Continuation of application Ser. No. 15/166,874, filed on May 27, 2016, which application is incorporated herein by reference.

TECHNICAL FIELD

The presently disclosed embodiments are directed to providing a printing system for use with depositing or printing stretchable and/or radiation curable inks on thermoformable substrates and methods of using the same.

BACKGROUND

Print processes compatible with thermoforming processes are known in the art. Conventional digital printers operate by scanning an array of printheads repeatedly across the media web while indexing the travel of the web, i.e., similar to the raster like functioning of traditional ink jet printers. This conventional print process is extremely time consuming in a manufacturing environment in which printed rolls must be delivered to one or more thermoforming presses. Often, the time required to print greatly exceeds the time necessary for thermoforming.

The following are two examples of printing systems used with thermoformable materials. Electronics For Imaging's VUTEk GS Pro-TF Series digital inkjet printer can allegedly produce custom formed signs, packaging, POP displays, vending panels and other thermoforming applications. Similarly, FUJIFILM's Acuity Advance Select is a flatbed inkjet printer used to produce printed thermoforms. Unfortunately, both systems suffer from the drawback of utilizing a scanning printhead which severely limits system throughput, e.g., FUJIFILM's system advertises throughput up to only 32 $m^2$/hr.

Further complicating the process of printing on thermoformable material is the optical characteristics of that material. Many thermoformable materials are transparent, which is a desirable characteristic when being used to hold product that consumers wish to see prior to purchase, e.g., strawberries in a clear plastic container. Clear materials pose a challenge for printing conventional CMYK images (cyan, magenta, yellow and key (black)) since incident light will transmit through the ink. To improve visibility, it is common to print a CMYK image onto a white background having high reflectance. In order to maximize the usefulness of a printing system and minimize costs, preferably the white background is created using the same printing process used for CMYK printing. However, if white is printed on the substrate immediately before the CMYK color separations, the color inks may bleed into and mix with the white, causing unacceptable print quality.

The present disclosure addresses a system and method for high throughput printing on thermoformable substrates without unacceptable color bleed or mixing.

SUMMARY

Broadly, the present printing system is intended for use with curable inks, e.g., radiation curable inks. In some embodiments, the printing system is intended for digitally preprinting labels onto thermoformable grade plastic which is subsequently thermoformed into a useful object such as a container. It has been found that when printing with a UV curable CMYKW ink set that it is necessary to treat the white ink differently than the CMYK inks.

From a productivity perspective, i.e., throughput, it is desired to provide a system in which the three primary components are independent of each other: a) extrusion of raw material into web form; b) printing on to the web; and, c) formation of the web into the end articles, such as containers. Such a system can provide greater flexibility and can deliver higher uptime than a system in which these components are integrated in an in-line manner. The foregoing system requires a printing architecture that can accept a roll of thermoforming grade plastic, print digitally on the plastic with suitable inks, and then deliver the printed roll for later conversion to thermoforms.

Broadly, an embodiment of a printing system arranged to provide a printed thermoformable web includes: a) a web unwinder; b) a treatment station to modify the substrate surface energy; c) a conventional web drive and tracking subsystem; d) one or more full-width arrays of printheads; e) an ink delivery subsystem; f) a radiation-curable ink set capable of stretching by at least 400% during thermoforming; g) one or more radiation curing devices; h) an in-line sensor to monitor print quality on the web; and, i) a web rewinder.

In view of the foregoing, an embodiment of the present system for printing at least one stretchable ink on a thermoformable substrate includes an unwinder arranged to feed the thermoformable substrate from a first roll into a web drive subsystem, a surface energy modification device arranged to alter a substrate surface energy to enhance wetting and adhesion of the at least one stretchable ink to the thermoformable substrate, at least one full width printhead array arranged to deposit the at least one stretchable ink on the thermoformable substrate, at least one radiation curing device arranged to cure the at least one stretchable ink on the thermoformable substrate, a full width array sensor arranged to monitor the at least one stretchable ink on the thermoformable substrate, and a rewinder arranged to receive the thermoformable substrate and to form the thermoformable substrate into a second roll.

Broadly, an embodiment of the above described printing system performs the following steps: a) treating a substrate with a first corona; b) printing a white background layer; c) fully curing the white background layer; d) treating the cured white background layer with a second corona; e) printing a CMYK image onto the cured white background layer; and, f) fully curing the CMYK image. In short, the foregoing method is a two pass printing method that can achieve the described printing process for UV curable inks. In the first pass, a white layer is printed and cured, while in the second pass, the white layer is corona treated and the CMYK inks are printed and cured.

Broadly, in view of the foregoing, another embodiment of the present method for applying an image on a thermoformable substrate includes: a) modifying a first surface energy of the thermoformable substrate with a surface energy modification device; b) depositing a background layer on a portion of the substrate with at least one full width printhead array, the background layer comprising at least one stretchable ink; c) curing the background layer to form a first printed substrate with at least one radiation curing device; d) modifying a second surface energy of the first printed substrate with the surface energy modification device; e) depositing a foreground layer on the background layer with at least one full width printhead array, the foreground layer comprising at least one stretchable ink; and, f) curing the foreground layer to form a second printed substrate with at least one radiation curing device.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
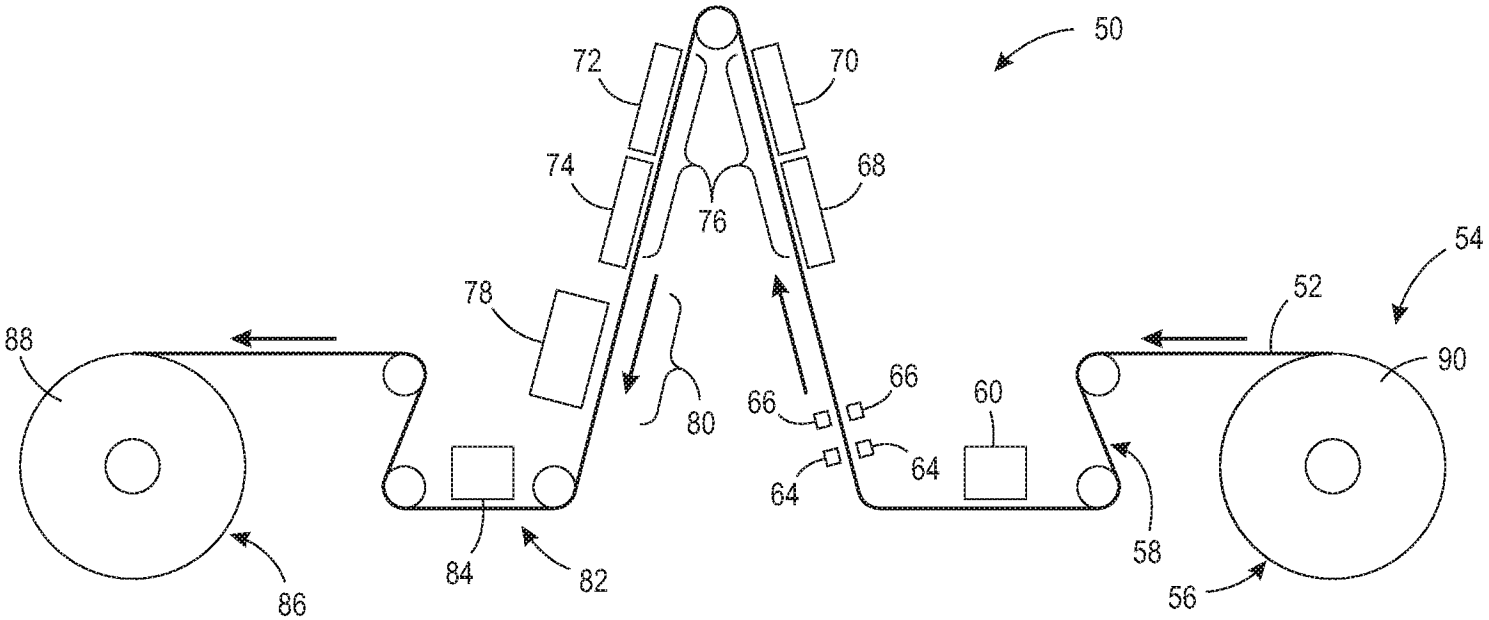
FIG. 1 is a schematic diagram of an embodiment of a present system for printing stretchable ink on a thermoformable substrate.

At the outset, it should be appreciated that like drawing numbers on different drawing views identify identical, or functionally similar, structural elements of the embodiments set forth herein. Furthermore, it is understood that these embodiments are not limited to the particular methodologies, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "full width", e.g., "full width array sensor" and "full width printhead array", is intended to be broadly construed as any structure that covers a significant width of the substrate. For example, in some embodiments, the length of a full width array sensor is approximately half of the width of the substrate which it inspects.

Furthermore, the words "printer," "printer system", "printing system", "printer device" and "printing device" as used herein encompass any apparatus, such as a digital copier, bookmaking machine, facsimile machine, multi-function machine, etc. which performs a print outputting function for any purpose. Additionally, as used herein, "web", "substrate", "printable substrate" refer to, for example, paper, transparencies, parchment, film, fabric, plastic, photo-finishing papers or other coated or non-coated substrate media in the form of a web upon which information or markings can be visualized and/or reproduced, while a "thermoformable substrate" is intended to mean any substrate capable of being thermoformed after printing, i.e., capable of being shaped by the use of heat and pressure. As used herein, the term 'average' shall be construed broadly to include any calculation in which a result datum or decision is obtained based on a plurality of input data, which can include but is not limited to, weighted averages, yes or no decisions based on rolling inputs, etc.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, although any methods, devices or materials similar or equivalent to those described herein can be used in the practice or testing of these embodiments, some embodiments of methods, devices, and materials are now described.

FIG. 1 depicts a schematic view of an embodiment of a present printing system, i.e., printing system 50. Thermoforming grade substrate 52, e.g., polyethylene terephthalate (PET) or polyvinyl chloride (PVC), is unwound at first end 54 of system 50 in unwinder 56. Web 52 then passes through a conventional web drive and steering subsystem, i.e., subsystem 58. Web 52 is exposed to surface energy modification device 60, e.g., corona discharge, atmospheric plasma, or flame treatment. Surface energy modification device 60 enhances both the wetting and adhesion of ink 62 to web 52. An example of a suitable surface energy modification device is a corona treatment device from Enercon of Milwaukee, Wis. with a typical output power of $$0-100\frac{\mathrm{W}\cdot\mathrm{min}}{m^2}.$$

In some embodiments, printing system 50 may also include web cleaning stations 64 and static neutralization devices 66 to remove excess particles and static charge from the substrate. In some embodiments, stations 64 and devices 66 are located on both sides of web 52 between surface energy modification device 60 and printhead array 68. Web 52 then passes by one or more printhead arrays, e.g., printhead arrays 68, 70, 72 and 74. In some embodiments, each printhead array is composed of multiple piezo printheads arranged so that the full width of web 52, other than inboard and outboard margins, can be addressed by at least one printhead without the need to move or scan the printhead. The foregoing arrangement of printheads allows for a 'single pass' print mode in which web 52 moves continuously through print zone 76, i.e., the area where web 52 passes adjacent to printhead arrays 68, 70, 72 and 74. It has been found that the foregoing embodiments can print over a speed range of 30-120 feet per minute. The full width printhead arrays of system 50 are stationary, i.e., not scanning transversely across web 52, which enables much higher printing throughput than conventional printers.

FIG. 1 shows one printhead array for each of the four conventional colors, i.e., cyan, magenta, yellow and black, also commonly referred to as CMYK. The four printhead arrays are represented by arrays 68, 70, 72 and 74 for the CMYK colors, respectively. An additional array or a plurality of additional arrays can be included for a fifth color, e.g., white, or for a plurality of additional colors. The printhead arrays are responsible for adding digitally defined image content to substrate 52, such as package graphics, instructions, and the like. The printhead arrays may also print non-image marks such as registration marks for subsequent thermoform processing, cutting operations, or other post printing processes that require alignment to the printed image.

It should be appreciated that corresponding ink delivery subsystems for each printhead array are not shown in the figures or discussed in detail herein as such subsystems are generally known in the art of liquid and solid ink printing. Each ink delivery subsystem supplies its corresponding printhead array with a radiation-curable thermoforming ink. It has been found that suitable inks should be formulated to allow for stretching of at least 400% elongation without cracking or losing adhesion to the substrate. However, the extent of necessary stretching is dependent on the thermoforming process and inks providing less than 400% elongation without cracking or loss of adhesion to the substrate may also be suitable for some applications.

After all ink has been deposited onto the substrate, the web then passes through a radiation curing zone, where such radiation source is selected based on the requirements for fully curing the ink. In some embodiments, multiple wide spectrum UV lamps provide curing of the inks, although other devices such as UV spectrum LED arrays may also be used, i.e., the necessary radiation output is dependent on the curing requirements of the ink. Thus, radiation curing device 78 may be selected from the group consisting of: an ultraviolet radiation source; an infrared radiation source; a visible light radiation source; and, combinations thereof, depending on the requirements of the stretchable ink. After web 52 passes through curing zone 80 it passes through sensing subsystem 82 which can be used to detect color-to-color registration, missing jets, and other print quality metrics. In some embodiments, sensing subsystem 82 comprises full width array sensor 84. Web 52 then passes into rewinder 86 where printed web 52 is returned to a roll form, e.g., roll 88. Printed roll 88 can be used in a thermoforming press and thereby converted into thermoformed objects, e.g., food packaging containers.

In some embodiments, web substrate 52 is 0.014 inch thick thermoforming grade PET, although other thermoformable plastics may also be used. In some embodiments, print resolution of 600 dots per inch (dpi)×600 dpi is acceptable, although other print modes may be used, e.g., 300 dpi×300 dpi.

In view of the foregoing, it should be appreciated that system 50 is capable of printing at least one stretchable ink on a thermoformable substrate, e.g., substrate 52. In some embodiments, system 50 comprises unwinder 56, surface energy modification device 60, at least one full width printhead array, e.g., printhead arrays 68, 70, 72 and 74, at least one radiation curing device, e.g., curing device 78, full width array sensor 84 and rewinder 86. Unwinder 56 is arranged to feed thermoformable substrate 52 from first roll 90 into web drive subsystem 58. Surface energy modification device 60 is arranged to alter a substrate surface energy to enhance wetting and adhesion of the at least one stretchable ink to thermoformable substrate 52. The full width printhead arrays are arranged to deposit the at least one stretchable ink on thermoformable substrate 52. Radiation curing device 78 is arranged to cure the at least one stretchable ink on thermoformable substrate 52. Full width array sensor 84 is arranged to monitor the at least one stretchable ink on thermoformable substrate 52, and rewinder 86 is arranged to receive thermoformable substrate 52 and to form thermoformable substrate 52 into second roll 88.

In some embodiments, each of the at least one stretchable ink is an ultraviolet radiation curable ink; however, other types of inks may also be used. Moreover, in some embodiments, thermoformable substrate 52 is selected from the group consisting of: polyethylene terephthalate; polyethylene terephthalate glycol-modified; polycarbonate; acrylic; polyvinyl chloride; acrylonitrile butadiene styrene; polypropylene; and, combinations thereof.

As described above, surface energy modification may be provided by a variety of devices. In some embodiments, surface energy modification device 60 is selected from the group consisting of: a corona treatment station; an atmospheric plasma treatment station; a flame treatment station; and, combinations thereof. In some embodiments, thermoformable substrate 52 comprises a first width and surface energy modification device 60 comprises a second width/length greater than the first width. Depending on system and printing requirements, it is also within the scope of the claims to have a surface energy modification device that is smaller/shorter than the width of thermoformable or printable substrate 52.

Similarly, in some embodiments, each full width printhead array dispenses a unique stretchable ink. In other terms, each full width printhead array dispenses a particular color unique to that printhead array. Thus, a first full width printhead array 68 may dispense cyan ink, while a second printhead array 70 dispenses magenta ink, a third printhead array 72 dispenses yellow ink, and a fourth printhead array 74 dispenses black ink. In some embodiments, thermoformable substrate 52 comprises a first width and the at least one full width printhead array, e.g., arrays 68, 70, 72 and/or 74, comprises a second width/length less than the first width. Depending on system and printing requirements, it is also within the scope of the claims to have printhead arrays that are equal to or greater than the width of the thermoformable or printable substrate. However, in embodiments having printhead arrays with widths/lengths greater than that of the thermoformable substrate, some piezo printheads must be turned off, i.e., the printheads falling outside of the substrate, to avoid waste of ink or damage to the overall system.

Figure 2:
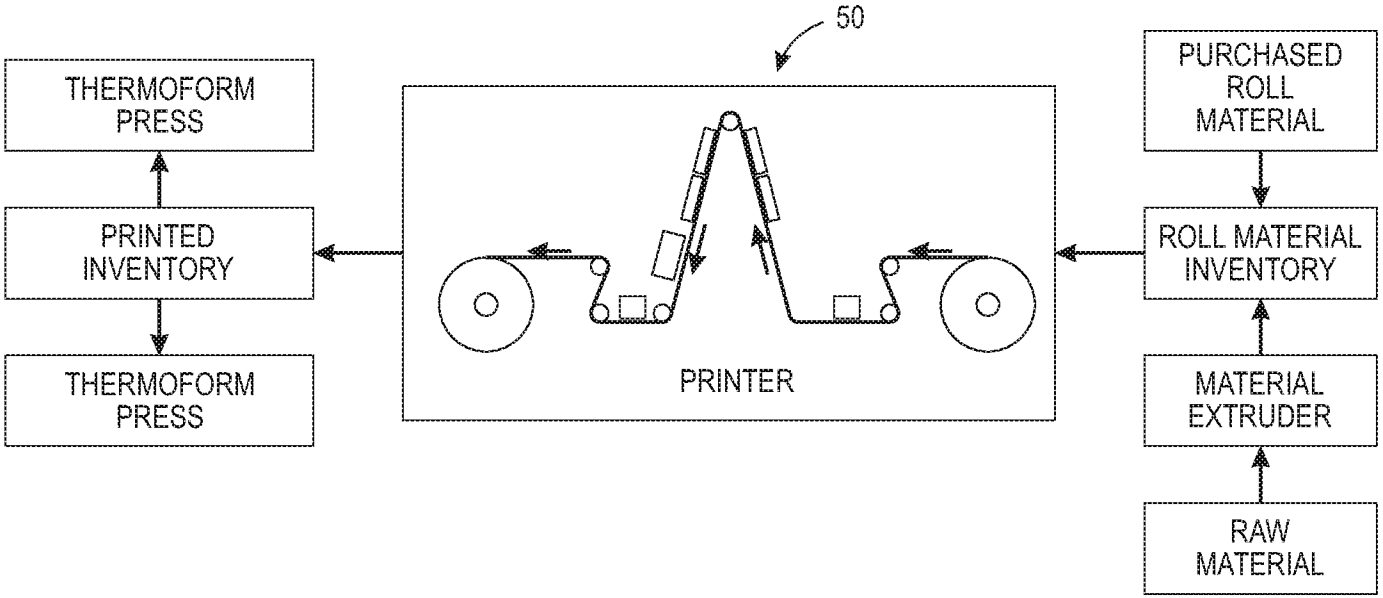
FIG. 2 is a schematic process flow diagram including an embodiment of a present system for printing stretchable ink on a thermoformable substrate.

FIG. 2 depicts a schematic view of an embodiment of printer 50 within an example of a full thermoforming manufacturing process. The benefits of printing in a roll-to-roll mode are evident versus a fully integrated in-line system. For example, depending on throughput rates of extruders, printers, and thermoform presses, it is possible for a highly flexible and reconfigurable manufacturing process with high uptime if any one component is down for servicing or otherwise unavailable for its contribution to the overall process.

Figure 3:
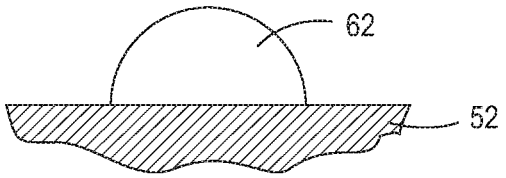
FIG. 3 is a cross sectional view depicting the interaction of a stretchable ink with a thermoformable substrate having a low surface energy.
Figure 4:
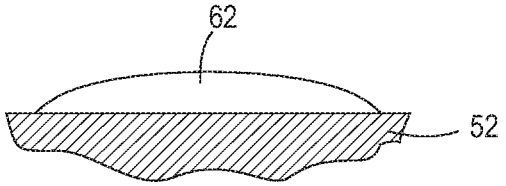
FIG. 4 is a cross sectional view depicting the interaction of a stretchable ink with a thermoformable substrate having a surface energy higher than the surface energy depicted in FIG. 3.

FIG. 3 depicts a cross sectional view showing the interaction of stretchable ink 62 with thermoformable substrate 52 having a low surface energy, while FIG. 4 depicts a cross sectional view showing the interaction of stretchable ink 62 with thermoformable substrate 52 having a surface energy higher than the surface energy depicted in FIG. 3. Surface energy modification, e.g., corona treatment, increases the surface energy of a printable substrate to improve wettability and adhesion of inks and coatings. Some printable substrates, e.g., polymer films, have chemically inert and non-porous surfaces with low surface tensions that cause poor reception of printing inks and coatings. Surface tensions are indicative of surface energy which is also commonly referred to as dyne level. Surface treatment, such as corona treatment, increases the surface energy of the printable substrate, thereby improving print quality through improved wettability and adhesion of inks. Generally, it is believed that a substrate will be wetted if its surface energy is higher than the surface energy of the ink. The level of surface energy modification depends on a variety of factors, including but not limited to the type of treatment used, the substrate and the ink characteristics. Thus, the required intensity of treatment, i.e., the number of watts per minute per substrate surface area $$\left(\frac{\mathrm{W}\cdot\mathrm{min}}{m^2}\right),$$

is best determined for each combination of substrate and ink. The same determination should be made when using different production runs of the same substrate and/or ink to achieve optimal printing results.

Figure 5:
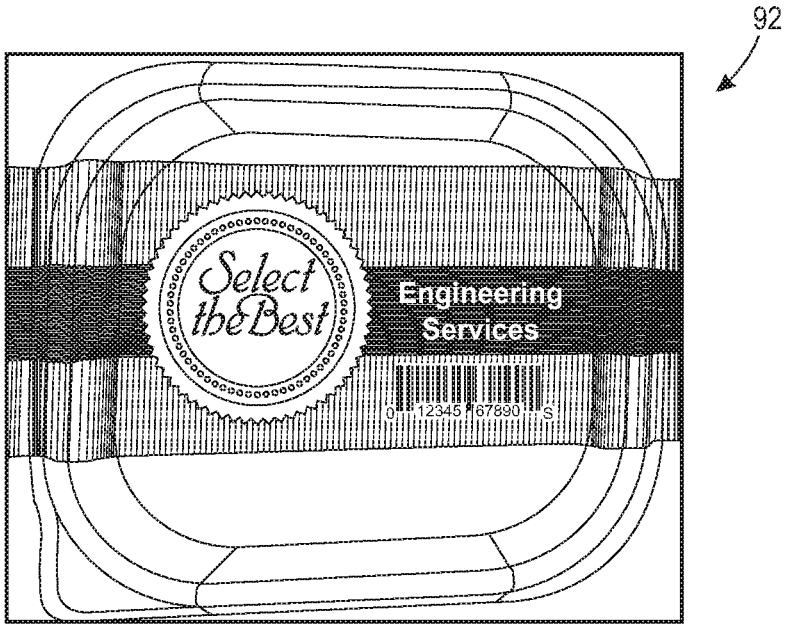
FIG. 5 is a top plan view of an example thermoformed article manufactured using printed material from a present system for printing stretchable ink on a thermoformable substrate.

FIG. 5 depicts a sample printed thermoform, i.e., thermoform article 92, as would be produced using the above described process. In this example, after printing a thermoform substrate roll, the roll was used in a thermoforming process at a different location.

Figure 6:
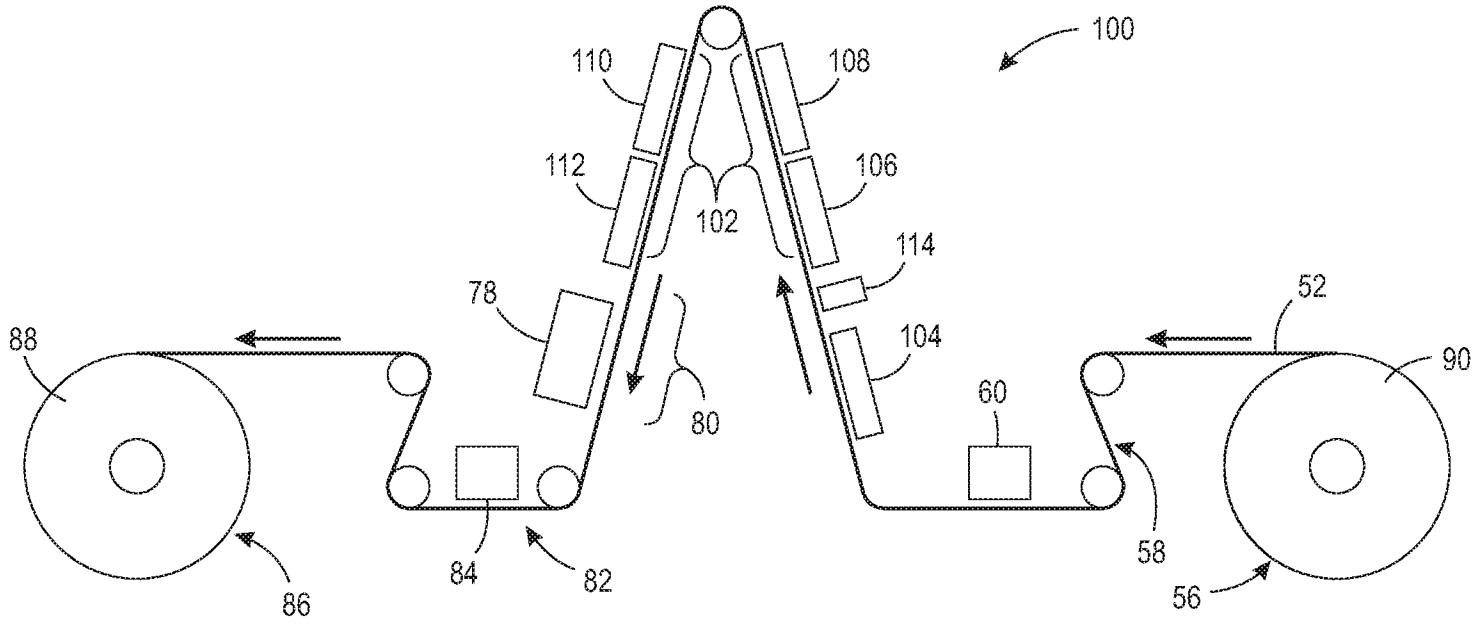
FIG. 6 a schematic diagram of another embodiment of a present system for printing stretchable ink on a thermoformable substrate including a radiation pinning device after the first printhead array; and, FIG. 7 a flow diagram of an embodiment of a present method for applying an image on a thermoformable substrate.

FIG. 6 depicts a schematic view of an embodiment of a present printing system for use in producing rolled printed thermoforming substrates, i.e., printing system 100. System 100 is similar to system 50 described above, with several additional elements. Thermoforming grade substrate 52, such as PET or PVC, is unwound in unwinder portion 56. Web 52 then passes through conventional web drive and steering components, i.e., subsystem 58. As the web drive and steering components are known in the art, they are not discussed in further detail herein. Web 52 is then exposed to surface energy modification device 60. Suitable surface energy modification devices include but are not limited to a corona treatment station, an atmospheric plasma treatment station, and a flame treatment station. As described above, the purpose of device 60 is to enhance both the wetting and adhesion of ink 62 to substrate 52. Both web cleaning stations and static neutralization devices to remove excess particles and static charge from the substrate may be included in system 100 but are not shown in this figure.

Web 52 then passes into printing zone 102 which is composed of multiple printhead arrays, i.e., printhead arrays 104, 106, 108, 110 and 112. Each printhead array is composed of multiple piezo printheads arranged so that the full width of web 52, other than inboard and outboard margins, can be addressed by at least one printhead. This arrangement allows for a 'single pass' print mode in which web 52 moves continuously through print zone 102. Within print zone 102, web 52 passes first by printhead array 104, which in this embodiment is associated with the color white, a common printed base layer. Array 104 prints a white background image. UV pinning device 114 is positioned after array 104 but before array 106 so that the ink deposited from array 104 is partially cured or 'pinned' to prevent subsequent mixing of inks with the background layer/image, e.g., the white background layer. It should be appreciated that as described above, the curing device or devices, as well as the pinning device, may emit radiation other than ultraviolet radiation, and such radiation is dependent upon the requirements of the ink. After passing by the pinning device(s), i.e., pinning device 114, the pinned white background is overprinted by the CMYK printhead arrays, i.e., printhead arrays 106, 108, 110 and 112. After all ink has been deposited onto the background layer/image and/or substrate 52, web 52 then passes through curing zone 116. In some embodiments, multiple wide spectrum UV lamps are used to cure the inks, although other devices such as UV spectrum LED arrays, or non-UV radiation sources are also suitable, depending on the requirements of the inks. After web 52 passes through curing zone 80 it passes through sensing subsystem 82 which comprises full width array sensor 84 to detect color-to-color register, missing jets, and other print quality metrics. Web 52 then passes into rewinder 86 where printed web 52 is returned to a roll form, e.g., roll 88.

It has been found that systems 50 and 100 must be tuned for a particular ink, radiation source, etc. An optimal state of pinning cure for the background layer prior to CMYK overprinting must be determined. If the background layer is undercured, then color mixing occurs with objectionable defects. If the background layer is overcured, then its surface energy drops and the CMYK inks do not spread sufficiently to achieve an acceptable solid fill. Sensing subsystem 82 may be used to quantify the overall quality of printed web 52, thereby facilitating tuning or optimization of systems 50 and 100. Such optimization may include but is not limited to adjusting the web speed, tuning the surface energy modification, e.g., increasing or decreasing its input power, increasing or decreasing the quantity of printed ink, tuning one or more of the curing devices, etc.

In view of the foregoing need for process optimization, modifications to the present printing system have been made. The following embodiments of printing systems and methods may be used to accomplish the desired printed rolled thermoforming substrate with reduced process optimization. FIG. 6 shows a schematic view of printing system 100, which example embodiment improves the overall printed results. As can be seen by a comparison of system 50 (FIG. 1) and system 100 (FIG. 6), system 50 does not include pinning device 114, i.e., the pinning/curing device positioned immediately after the background layer/image printhead array. System 100 functions similarly to other embodiments described above. Web 52 is unwound by unwinder 56 and subsequently treated by exposure to surface energy modification device 60. Web 52 then passes printhead array 104 where a background layer/image is deposited on web 52. The background layer/image is fully cured in curing zone 80 by curing device 82, the background image is inspected by sensing subsystem 82 and subsequently rewound into roll 88 by rewinder 86. Roll 88 becomes the new roll 90 and is then refed though system 100 a second time. Web 52 having the background layer printed thereon is unwound by unwinder 56 and subsequently treated by exposure to surface energy modification device 60. In this instance, surface energy modification device 60 alters the surface energy of both web 52 and the background layer/image cured thereon. Web 52 with the background layer/image cured thereon then passes printhead arrays 106, 108, 110 and 112, i.e., printing zone 102, where a CMYK image is deposited on web 52 and/or the background layer. The CMYK image is fully cured in curing zone 80 by curing device 78, the completed image is inspected by sensing subsystem 82 and subsequently web 52 is rewound into roll 88 by rewinder 86.

In short, the foregoing embodiments deposit or print CMYKW images via two independent passes of substrate 52 through printer system 100, without the use of pinning device 114. In other terms, a roll of material, i.e., a roll of thermoformable substrate, is sent through printer 100 twice. In the first pass, only the background layer/image is printed and then fully cured. It is within the scope of the present disclosure to print limited amounts of CMYK directly onto the substrate in order, for example, to create any registration marks or background layer other than white, and such printing can occur during the first pass through the printing system. The printed substrate resulting from the first pass is rewound into a roll and then reintroduced to the printing system for a second pass. During the second pass, the cured background layer/image is corona treated to enhance wetting of ink on its surface, i.e., the background layer/image is exposed to the surface energy modification device. The CMYK image content is aligned to any previously printed registration marks and is overprinted on the background layer/image and then fully cured. The substrate is rolled up a second time and is then in condition for installation onto a thermoforming press.

Figure 7:
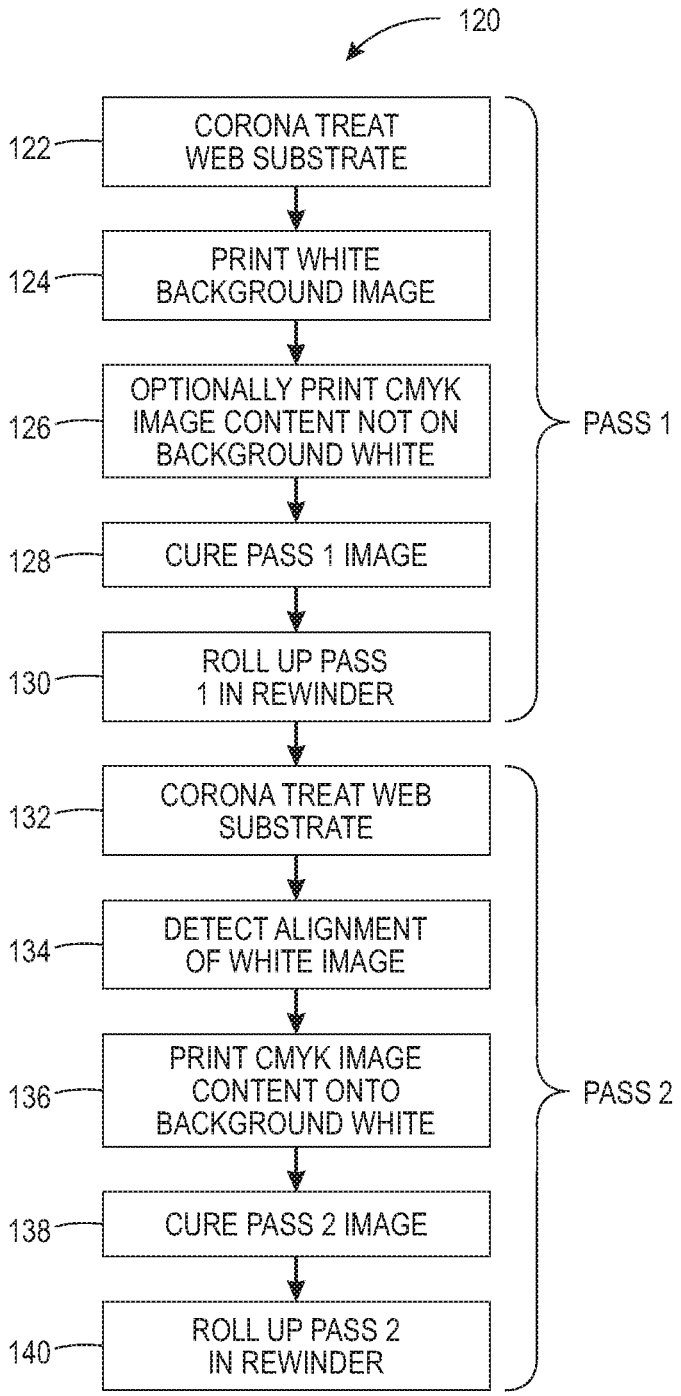

The foregoing printing process is depicted in FIG. 7 as printing process 120. Web 52 is fed into printing system 100 at unwinder 56 from roll 90. Web 52 is treated with surface energy modification device 60 at Step 122. A background layer/image, e.g., a white background, is printed on web 52 by printhead array 104 at Step 124. Optionally, CMYK image content may be printed on web 52 by printhead arrays 106, 108, 110 and 112 at Step 126. Such content may include but is not limited to fiducials, alignment marks, image content falling outside the background layer/image, etc. The collective printed image on web 52 from the first pass through printing system 100 is cured by curing device 78 at Step 128. Web 52 is then rewound by rewinder 86 into roll 88 at Step 130. Roll 88 then becomes the new roll 90 which is again fed into unwinder 56 of system 100. Web 52, now including the background layer/image and any CMYK first pass image(s), is treated with surface energy modification device 60 at Step 132. The position of the background layer/image is directly detected or detected via the position of alignment marks with position detection or sensing system 82 at Step 134. A CMYK image is printed on web 52 in whole or in part on the background layer/image by printhead arrays 106, 108, 110 and 112 at Step 136. The CMYK image on web 52 from the second pass through printing system 100 is cured by curing device 78 at Step 138. Web 52 is then rewound by rewinder 86 into roll 88 at Step 140.

In view of the foregoing, it should be appreciated that in some embodiments the present method for applying an image on a thermoformable substrate comprises the following. First, the surface energy of thermoformable substrate 52 is modified with surface energy modification device 60. Then, a background layer is deposited on at least a portion of substrate 52 with at least one full width printhead array 104. The background layer comprises at least one stretchable ink, e.g., a white ink. Next, the background layer is cured with at least one radiation curing device 78 to form a first printed substrate. The foregoing steps, i.e., the first pass through system 100, are now largely repeated, i.e., the second pass through system 100. The surface energy of the first printed substrate is modified with surface energy modification device 60. Next, a foreground layer is deposited on the background layer and/or substrate with at least one full width printhead array 106, 108, 110 and/or 112. The foreground layer comprises at least one stretchable ink, e.g., cyan, magenta, yellow and/or black ink. Then, the foreground layer is cured with at least one radiation curing device 78 to form a second printed substrate.

In some embodiments, the foregoing method further comprises forming roll 88 of the first printed substrate using rewinder 86 after the first pass through system 100. Similarly, in some embodiments, the foregoing method further comprises forming roll 88 of the second printed substrate using rewinder 86 after the second pass through system 100.

The printing system disclosed above provides a high throughput digital thermoform printer. Various embodiments and combinations of embodiments of the printing system include: a web unwinder; a treatment station to modify the substrate surface energy; a conventional web drive and tracking subsystem; one or more full-width arrays of printheads; an ink delivery subsystem; a radiation-curable ink set capable of stretching, e.g., by at least 400%, during thermoforming; one or more radiation curing devices; an in-line sensor to monitor print quality on the web; and, a rewinder. Benefits of the present printing system include but are not limited to: high throughput digital manufacturing capability for thermoformable materials; a digital (variable) printed labels which eliminate the need for adhesive backed paper or resin based labels; ease of recycling; and, the surface energy modifier also removes contamination. The present printing system reduces the costs associated with the production of labeled thermoformable containers by eliminating the steps of producing and applying a label.

The present disclosure also includes a two-step process for printing on a web or substrate to be thermoformed. In the first pass, a background layer/image such as a white layer is printed and cured. In the second pass, the background layer/image is treated to alter its surface energy and the CMYK inks are then printed and cured. Benefits of these embodiments include that the method produces clearly improved results from alternative methods.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A system for printing a background layer and a foreground layer on a thermoformable substrate comprising:

an unwinder arranged to feed the thermoformable substrate from a first roll into a web drive subsystem;

a surface energy modification device arranged downstream from the unwinder and arranged to alter a substrate surface energy of the thermoformable substrate to enhance wetting and adhesion of one or more of the background layer and the foreground layer, each of which include a stretchable ink, to the thermoformable substrate;

a first printhead array arranged downstream from the surface energy modification device and arranged to deposit the background layer on the thermoformable substrate;

a first radiation curing device arranged downstream from the first printhead array and arranged to cure the background layer deposited on the thermoformable substrate;

a second printhead array arranged downstream from the first radiation curing device and arranged to deposit the foreground layer on the thermoformable substrate, the deposited background layer and the deposited foreground layer forming an image on the thermoformable substrate on the basis that the thermoformable substrate and the image will be subject to a subsequent thermoforming process that affects the shape of the thermoformable substrate and the image;

a second radiation curing device arranged downstream from the second printhead array and arranged to cure the foreground layer deposited on the thermoformable substrate;

a sensor array arranged downstream from the second radiation curing device and arranged to monitor characteristics of the deposited background layer and the deposited foreground layer on the thermoformable substrate, the characteristics including at least one of color-to-color register and missing jets; and, a rewinder arranged downstream from the sensor array and arranged to receive the thermoformable substrate including the deposited background layer and the deposited foreground layer and to form the thermoformable substrate into a second roll.

2. The system for printing of claim 1 wherein each of the stretchable ink is an ultraviolet radiation curable ink.

3. The system for printing of claim 1 wherein the thermoformable substrate is selected from the group consisting of: polyethylene terephthalate; polyethylene terephthalate glycol-modified; polycarbonate; acrylic; polyvinyl chloride; acrylonitrile butadiene styrene; polypropylene; and, combinations thereof.

4. The system for printing of claim 1 wherein the surface energy modification device is selected from the group consisting of: a corona treatment station; an atmospheric plasma treatment station; a flame treatment station; and, combinations thereof.

5. The system for printing of claim 1 wherein the thermoformable substrate comprises a first width and the surface energy modification device comprises a second width greater than the first width.

6. The system for printing of claim 1 wherein each printhead array of the first and second printhead arrays comprises a plurality of piezo printheads.

7. The system for printing of claim 1 wherein the second printhead array includes a plurality of printhead sub-arrays each capable of dispensing a unique stretchable ink.

8. The system for printing of claim 1 wherein the thermoformable substrate comprises a first width and the at least one printhead array comprises a second width less than the first width.

9. The system for printing of claim 1 wherein each of the first and second printhead arrays comprise at least one full width printhead array.

10. The system for printing of claim 1 wherein the first and second radiation devices are selected from the group consisting of: an ultraviolet radiation source; an infrared radiation source; a visible light radiation source; and, combinations thereof.

11. The system for printing of claim 1 wherein the sensor array comprises a full width sensor array.

12. The system of claim 1 further comprising at least one of: a cleaning station; and, a static neutralization device, positioned between the surface energy modification device and the first printhead array.

13. The system for printing of claim 1 further comprising a first cleaning station and a second cleaning station, wherein the first cleaning station is positioned adjacent to a first side of the thermoformable substrate and the second cleaning station is positioned adjacent to a second side of the thermoformable substrate opposite the first side.

14. The system for printing of claim 1 further comprising a first static neutralization device and a second static neutralization device, wherein the first static neutralization device is positioned adjacent to a first side of the thermoformable substrate and the second static neutralization device is positioned adjacent to a second side of the thermoformable substrate opposite the first side.

15. The system for printing of claim 1 wherein the stretchable ink is adapted for stretching of at least 400% elongation.

16. The system of claim 1, wherein the surface energy modification device arranged downstream from the unwinder is operatively arranged to alter a substrate surface energy of the thermoformable substrate including the deposited and cured background layer to enhance wetting and adhesion of the foreground layer.

* * * * *